US005078003A

United States Patent [19]

Oishi

[11] Patent Number: 5,078,003

[45] Date of Patent: Jan. 7, 1992

[54] OVERLOAD PROTECTOR FOR PRESS MACHINE

[75] Inventor: Yoshihiro Oishi, Sagamihara, Japan

[73] Assignee: Aida Engineering, Ltd., Kanagawa, Japan

[21] Appl. No.: 520,018

[22] Filed: May 7, 1990

[30] Foreign Application Priority Data

May 9, 1989 [JP] Japan ..... 1-53775[U]

[51] Int. Cl.[5] ..... B21B 25/00; B30B 15/14

[52] U.S. Cl. ..... 72/465; 72/453.13; 100/53

[58] Field of Search ..... 72/432, 465, 453.13; 100/53, 258 R, 258 A, 259

[56] References Cited

U.S. PATENT DOCUMENTS

| | | | |
|---|---|---|---|
| 2,937,733 | 5/1960 | Dunly | 100/53 |
| 3,426,873 | 2/1964 | Tezuka | 100/53 |
| 3,955,396 | 5/1976 | Carrieri | 72/432 |

FOREIGN PATENT DOCUMENTS 2184683 7/1987 United Kingdom .

*Primary Examiner*—Lowell A. Larson
*Assistant Examiner*—Michael J. McKeon
*Attorney, Agent, or Firm*—Lowe, Price, LeBlanc & Becker

[57] ABSTRACT

An overload protector for press machine protects a press machine from a damage when the press machine receives an overload in operation. It is applicable to a two-point type press machine with two connecting rods between a crank shaft and a slide. A pressurized oil supply means comprising a pressure generator and pressure oil supply line delivers pressurized oil to two hydraulic pressure chambers of two overload-protections means. The pressurized oil supply line has two relief valves connected thereto in hydraulic parallel to each other. Each of the relief valves receives the hydraulic pressure from one of the hydraulic pressure chambers reduced by an occurrence of a localized load and releases the hydraulic pressure contained in the other hydraulic pressure chamber so as to nullify the localized load.

8 Claims, 4 Drawing Sheets

OVERLOAD PROTECTOR FOR PRESS MACHINE

BACKGROUND OF THE INVENTION

1. Field of the Invention

The present invention relates to an apparatus for protecting components of a press machine from an overload occurring through pressing It is applicable to a two-point type press machine having two connecting rods respectively connecting a slide to a crank shaft.

2. Description of the Related Art

When a press machine receives more than a predetermined number of sheet blanks or a sheet blank having an undesirable thickness and presses them in succession, some components of the press machine receive an overload and thereby might be damaged. To overcome this problem the present applicant develoed a prior-art apparatus disclosed in examined Japanese patent publication No. 42-16388 and in FIG. 3 of the present invention.

As depicted in FIG. 3, a cylinder 2 provided within a slide 1 defines a hydraulic pressure chamber 3. The hydraulic pressure chamber 3 contains a pressure-receipt element 4 reciprocally movable in the cylinder 2. The top surface of the pressure-receipt element 4 is in contact with a spherical bottom end of a connecting rod 5 connecting a crank shaft (not shown) and the slide 1. A downward shoulder surface 6 in the hydraulic pressure chamber 3 and an upward shoulder surface 7 of the pressure-receipt element 4 constitute a shut-off valve or openable seal 8. A chamber 9 disposed above the seal 8 in the cylinder 2 communicates through an oil return line 10 with an oil reservoir 11. The hydraulic pressure chamber 3 receives pressurized oil boosted by a pressure booster 15 from the oil reservoir 11 through a pressurized oil supply line 14 having check valves 12 and 13 therein.

The pressure booster 15 delivers a predetermined pressurized oil into the hydraulic pressure chamber 3 so that a combination of a pressurized air from an air source 19 which is controlled by a changeover valve 18 and a return spring 20 alternately reciprocates a piston 17 of a booster pump 16.

The above-described hydraulic pressure chamber 3, pressure-receipt element 4, seal 8 and oil return line 10 constitute a hydraulic overload-protection means 21.

Rotation of the crank shaft vertically moves the slide 1 by means of the connecting rod 5 to press so that the connecting rod 5 applies a press load to the slide 1 through the pressure-receipt element 4 and pressurized oil contained within the hydraulic pressure chamber 3. The valve body 4, when receiving a downward overload in pressing, descends by this downward overload transmit&ed from the connecting rod 5 against a hydraulic pressure contained in the hydraulic chamber 3. Thereby, the seal 8 is opened and oil escaping through the seal 8 out of the hydraulic pressure chamber 3 returns to the oil reservoir 11 through the oil return line 10. Thus, the pressure-receipt element 4 descends relative to the slide 1 to open the seal 8 and thereby protect the components of the press machine from the overload.

The press machine comprises a two-point type press machine, i.e, press machine with two connecting rods 5 and two hydraulic overload-protection means 21.

FIG. 4 illustrates this prior-art two-point type press machine. Two left-hand and right-hand components, lines etc. of FIG. 4 have respective similar labels of FIG. 3 with letters A or B attached.

In accordance with the prior-art two-point type press machine, when one of left-hand and right-hand hydraulic overload-protection means 21A and 21B operates, a slide 1 tilts if the other of the left-hand and right-hand hydraulic overload-protection means 21A and 21B does not operate concurrently, which may damage a slide gib guiding a vertical movement of the slide 1. Thus, in accordance with the prior-art two-point type press machine, a communication line comprising branched lines 22A and 22B of a pressurized oil supply line 14 connects left-hand and right-hand hydraulic pressure chambers 3A and 3B, so that oil escaping through the opened seal 8 out of one of the hydraulic pressure chambers 3A and 3B returns to the oil reservoir 11 through a corresponding one of oil return lines 10A and 10B and oil contained in the other of hydraulic pressure chambers 3A and 3B also concurrently returns to the oil reservoir 11 through the same route as oil contained in the one of the hydraulic pressure chambers 3A and 3B. Thus, left-hand and right-hand pressure-receipt elements 4A and 4B are essentially concurrently descended relative to the slide 11.

Generally, parts of the underside of the slide 1 cannot receive uniform loads in pressing so that the underside of the slide 1 receives a localized load in response to the shape, dimensions etc. of a work to be pressed. Sensing the localized load concurrently with pressing is required for proper pressing However, the prior-art apparatus of FIG. 4 could not sense the localized load since if it would sense the localized load on the basis of the hydraulic pressures contained in the left-hand and right-hand hydraulic pressure chambers 3A and 3B and changing in pressing, the hydraulic pressure chambers 3A and 3B continuously communicated with each other, as described above, so that hydraulic pressures contained in the hydraulic pressure chambers 3A and 3B continuously equaled each other. In addition, the prior-art apparatus of FIG. 4 has equalized the hydraulic pressures delivered to the hydraulic pressure chambers 3A and 3B. In other words, the prior-art apparatus of FIG. 4 cannot have made different these hydraulic pressures in response to localized loads.

Another prior-art apparatus has been provided in which left-hand and right-hand hydraulic pressure chambers are hydraulically independent of each other and when a hydraulic overload-protection means of one of the hydraulic pressure chambers operates to change the hydraulic pressure contained in the one hydraulic pressure chamber, an electric means senses this change in the hydraulic pressure contained in the one hydraulic pressure chamber to operate a changeover valve connected to the other hydraulic pressure chamber so that the changeover valve allows pressurized oil to be released out of the other hydraulic pressure chamber to reduce the hydraulic pressure contained in the other hydraulic pressure. This prior-art apparatus has entailed a problem in that it produced a time lag between an operation of the one hydraulic overload-protection means and operation of the other hydraulic overload-protection means so that a slide became horizontally oblique to damage a slide gib.

SUMMARY OF THE INVENTION

An object of the present invention is to provide an overload protector for a press machine in which two hydraulic overload-protection means can essentially concurrently operate and changes in hydraulic pressures contained in left-hand and right-hand overload protection means can cause a localized load to be sensed.

Another object of the present invention is to provide an overload protector for a press machine which can delivers different hydraulic pressures to left-hand and right-hand hydraulic pressure chambers and can set hydraulic pressures in response to localized loads.

A first aspect of the present invention provides an overload protector for a press machine, the press machine having two hydraulic overload-protection means each of which comprises: a hydraulic pressure chamber receiving pressurized oil and defined in a slide connected by a connecting rod to crank shaft; a pressure receipt element vertically movably mounted within the hydraulic pressure chamber and receiving a press machine load transmitted from the connecting rod; an openable seal comprising a downward wall surface in the hydraulic pressure chamber and an upward surface of the pressure receipt element; and an oil return line returning oil escaping through the seal in an opened position out of the hydraulic pressure chamber. In accordance with the invention, the overload protector for the press machine has a single pressure generator and single pressurized oil supply line, the pressurized oil supply line has two branched lines each extending to the hydraulic pressure chamber and having a check valve blocking an oil flow from the hydraulic pressure chamber to the pressurized oil supply line, the branched lines have two relief valves connected therebetween and in hydraulic parallel to each other, and each of the relief valves comprises: a valve body movable between opened and closed positions and having two opposite pressure-receipt surfaces with different pressure-receipt areas, the pressure-receipt surfaces receive hydraulic pressures oppositely acting on each other and delivered from the hydraulic pressure chambers; and an oil relief line releasing oil which is contained in corresponding one of the hydraulic pressure chambers and applies the pressure thereof to corresponding one of the pressure-receipt surfaces with a small pressure-receipt area to an oil reservoir in response to the open position of the valve body.

A second aspect of the present invention provides a second overload protector for a press machine, the press machine being identical to the press machine defined above, the second overload protector being characterized in that it has a single pressure generator and single pressurized oil supply line extending to one of the hydraulic pressure chambers for each of the two hydraulic overload-protection means, and the pressurized oil supply lines have two relief valves connected therebetween in hydraulic parallel to each other and each having the above-described valve body and oil relief line.

In accordance with the overload protector for the press machine of the first aspect of the present invention, the check valves and relief valves separate the two hydraulic pressure chambers in normal pressing so that sensing the hydraulic pressures contained in the hydraulic pressure chambers by a pressure sensor can sense a localized load acting on the underside of the slide in pressing. When one of the two hydraulic overload-protection means receives an overload to open the seal of the one hydraulic overload-protection means and oil escaping through the opened seal out of the one hydraulic pressure chamber of the one hydraulic overload-protection means returns to the oil reservoir, a corresponding relief valve having a pressure-receipt surface with a large pressure-receipt area to which the hydraulic pressure transmitted from the one hydraulic pressure chamber is applied is opened by a hydraulic pressure transmitted from the other hydraulic pressure chamber applied to a pressure-receipt surface with a small pressure-receipt area of the corresponding relief valve. Thus, oil escapes through the opened seal of the other hydraulic overload-protection means out of the other hydraulic pressure chamber thereof to the oil reservoir, so that the hydraulic pressure contained in the other hydraulic pressure chamber is reduced to also operate the other hydraulic overload-protection means. Thus, both the hydraulic overload-protection means can be essentially concurrently operated by a hydraulic circuit.

In accordance with the overload protector for the press machine of the second aspect of the present invention, the relief valves separate the two hydraulic pressure chambers in normal pressing, so that as in the overload protector for the press machine of the first aspect of the present invention, sensing the hydraulic pressures contained in the hydraulic pressure chambers by a pressure sensor can sense the localized load in pressing acting on the underside of the slide. As in the overload protector for the press machine of the first aspect of the present invention, one of the two hydraulic overload-protection means receives an overload to open a corresponding relief valve so that the other hydraulic overload-protection means also operates.

In addition, the overload protector for the press machine of the second aspect of the present invention, which has a single pressure generator and single pressurized oil supply line provided for each of the two hydraulic overload-protection means, can set hydraulic pressures to be delivered to the hydraulic pressure chambers of the two hydraulic overload-protection means in response to the localized load acting on the underside of the slide in pressing

DESCRIPTION OF THE PREFERRED EMBODIMENTS

The preferred embodiments of the present invention will be described with reference to FIGS. 1 and 2. In the following description, elements and hydraulic lines of FIGS. 1 and 2 having the same configurations or functions as those of FIGS. 3 and 4 have the same labels and descriptions thereof will be abridged or will not be repeated.

Figure 1:
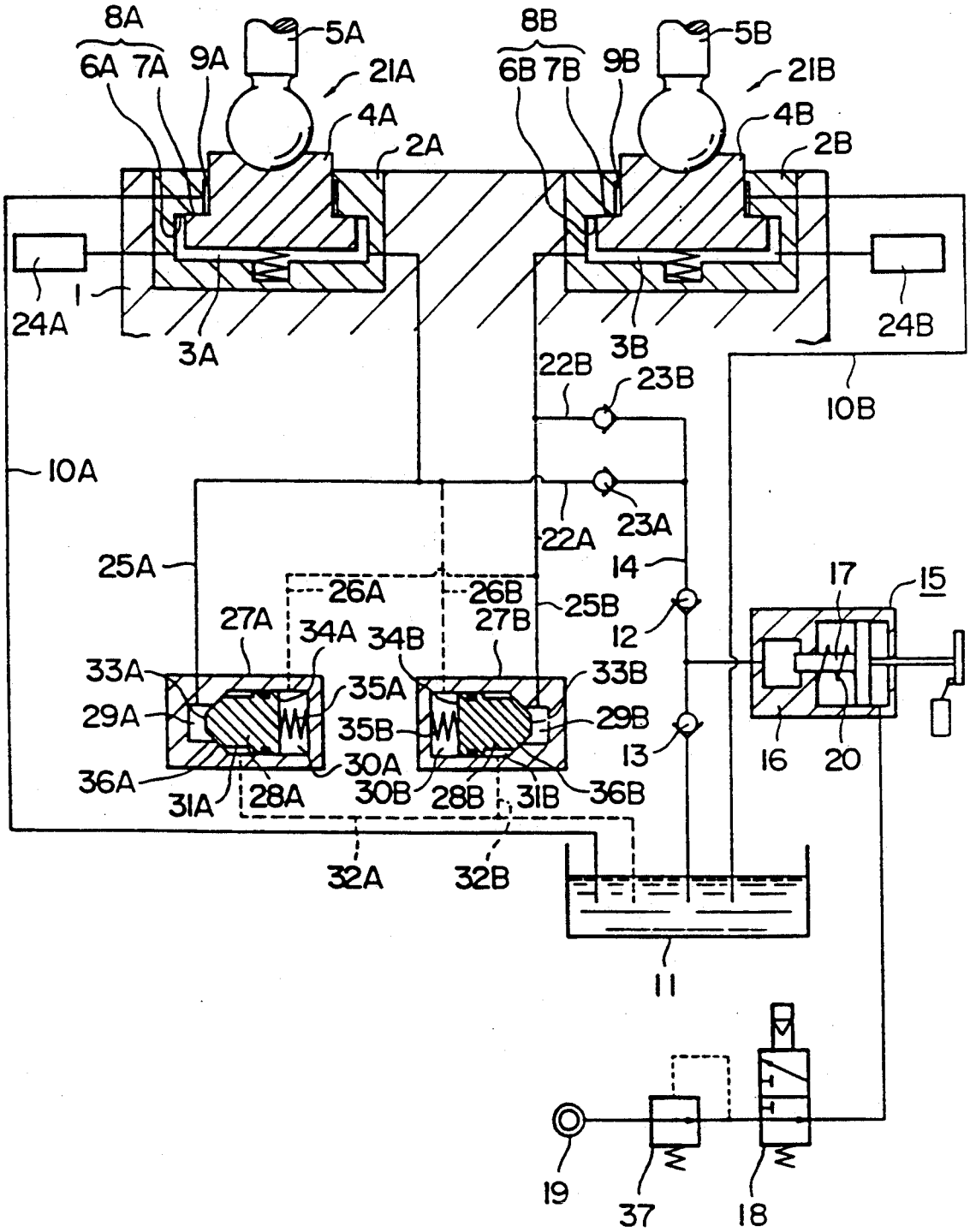
FIG. 1 is a hydraulic circuit diagram of a first embodiment of the present invention with a single pressure generator and single pressurized oil supply line.

FIG. 1 is an illustration of a first embodiment with a single pressure generator or booster 15 and single pressurized oil supply line 14 constituting a pressurized oil supply means.

The front end of the pressurized oil supply line 14 forms two branched lines 22A and 22B. The respective branched lines 22A and 22B extend to hydraulic pressure chambers 3A and 3B of left-hand and right-hand hydraulic overload-protection means 21A and 21B and have check valves 23A and 23B, respectively. The check valves 23A and 23B permit pressurized oil flows from the pressure booster 15 to the hydraulic pressure chambers 3A and 3B and on the other hand, block oil flows from the hydraulic pressure chambers 3A and 3B to the pressure booster 15 and an oil reservoir 11. Pressure sensors 24A and 24B communicate with the interiors of the left-hand and right-hand hydraulic pressure chambers 3A and 3B in order to sense changes in hydraulic pressures contained in the hydraulic pressure chambers 3A and 3B.

The branched line 22A has communication lines 25A and 26B and the branched line 22B has communication lines 25B and 26A. The communication lines 25A and 26A have a relief valve 27A provided therebetween and the communication lines 25B and 26B have a relief valve 27B connected therebetween. Thus, the two relief valves 27A and 27B are arranged in a hydraulic circuit parallel to each other between the two branched lines 22A and 22B.

The relief valves 27A and 27B have movable pivot-shaped valve bodies 28A and 28B mounted therewithin. The valve bodies 28A and 28B separate the interiors of valve casings of the relief valves 27A and 27B into front chambers 29A and 29B, rear chambers 30A and 30B and intermediate chambers 31A and 31B. The front chamber 29A continuously communicates with the hydraulic pressure chamber 3A. The rear chamber 30A continuously communicates with the hydraulic pressure chamber 3B. The front chamber 29B continuously communicates with the hydraulic pressure chamber 3B. The rear chamber 30B continuously communicates with the hydraulic pressure chamber 3A. The intermediate chambers 31A and 31B communicate through oil relief lines 32A and 32B with oil reservoir 11. The front surfaces of the valve bodies 28A and 28B facing the front chambers 29A and 29B provide small pressure-receipt surfaces 33A and 33B each having small pressure-receipt area. The rear surfaces of the valve bodies 28A and 28B facing the rear chambers 30A and 30B provide large pressure-receipt surfaces 34A and 34B each having large pressure-receipt area. Thus, the front and rear pressure-receipt surfaces of each of the valve bodies 28A and 28B receive hydraulic pressures from the respective hydraulic pressure chambers 3A and 3B oppositely to those of the other of the valve bodies 28A and 28B.

The valve bodies 28A and 28B are urged by the forces of return springs 35A and 35B into close contact with sealing surfaces 36A and 36B to shut off communications between the front chambers 29A and 29B and intermediate chambers 31A and 31B, i.e., to be moved to closed positions thereof. On the other hand, the valve bodies 28A and 28B are moved from the closed positions thereof to opened positions thereof to open communications between the front chambers 29A and 29B and intermediate chambers 31A and 31B so that oils escape out of the hydraulic pressure chambers 3A and 3B to the oil reservoir 11 through the oil relief lines 32A and 32B.

In accordance with the first embodiment, the hydraulic overload-protection means 21A and 21B essentially concurrently operate when a press pressure of 1.3-1.5 times a normal set hydraulic pressure occurs on one of the hydraulic pressure chambers 3A and 3B, and the pressure-receipt areas of the small pressure-receipt surfaces 33A and 33B of the valve bodies 28A and 28B are determined to be 1.5 times the pressure-receipt areas of the large pressure-receipt surfaces 34A and 34B of the valve bodies 28A and 28B. That is, a ratio between the pressure-receipt areas of the small pressure-receipt surfaces 33A and 33B of the valve bodies 28A and 28B of the relief valves 27A and 27B and that of a corresponding one of the large pressure-receipt surfaces 34A and 34B thereof is determined in response to a ratio between the normal set hydraulic pressure in the hydraulic pressure chambers 3A and 3B and a hydraulic pressure in the hydraulic pressure chambers 3A and 3B when the hydraulic overload-protection means 21A and 21B operate.

The operation of the overload protector for the press machine of the first embodiment will be described hereinafter.

The piston 17 of the pressure booster 15 is reciprocated by a combination of pressurized air supplied by an air source 19 through a changeover valve 18 and a return spring 20 so that the pressure booster 15 boosts the pressure of oil from the oil reservoir 11 and delivers the resulting pressurized oil through the pressurized oil supply line 14 and branched lines 22A and 22B to the hydraulic pressure chambers 3A and 3B. The regulator 37 of the hydraulic pressure booster 15 regulates the pressure of pressurized oil to be delivered to the hydraulic pressure chambers 3A and 3B.

When the slide 1 vertically moves to normally press, the hydraulic pressure contained in the hydraulic pressure chamber 3A is applied to both the small pressure-receipt surface 33A of the valve body 28A of the relief valve 27A and the large pressure-receipt surface 34B of the valve body 28B of the relief valve 27B and on the other hand, the hydraulic pressure contained in the hydraulic pressure chamber 3B is applied to both the large pressure-receipt surface 34A of the relief valve 27A and the small pressure-receipt surface 33B of the valve body 28B of the relief valve 27B, so that a difference between the pressure-receipt areas of the pressure-receipt surfaces 33A and 33B and difference between the pressure-receipt areas of the pressure-receipt surfaces 34A and 34B maintain the valve bodies 28A and 28B in the closed positions in which the valve bodies 28A and 28B are in close contact with the sealing surfaces 36A and 36B.

Thus, the combinations of the check valves 23A and 23B and relief valves 27A and 27B separate the left-hand and right-hand hydraulic pressure chambers 3A and 3B from each other. A press machine operates under this condition.

Even when a localized load produced in pressing a work and acting on the underside of the slide 1 makes different press pressures applied to the respective hydraulic overload-protection means 21A and 21B to cause a difference between the hydraulic pressures contained in the hydraulic pressure chambers 3A and 3B, the valve bodies 28A and 28B maintain the closed positions thereof when the difference between these hydraulic pressures is smaller than forces produced on differences in pressure-receipt areas between the small pressure-receipt surfaces 33A and 33B and large pressure-receipt surfaces 34A and 34B of the valve bodies 28A and 28B.

In pressing under this condition, the pressure sensors 24A and 24B continuously sense changes in the hydraulic pressures contained in the hydraulic pressure chambers 3A and 3B hydraulically independent from each other as described above with localized loads acting on the underside of the slide concurrently sensed.

Figure 3:
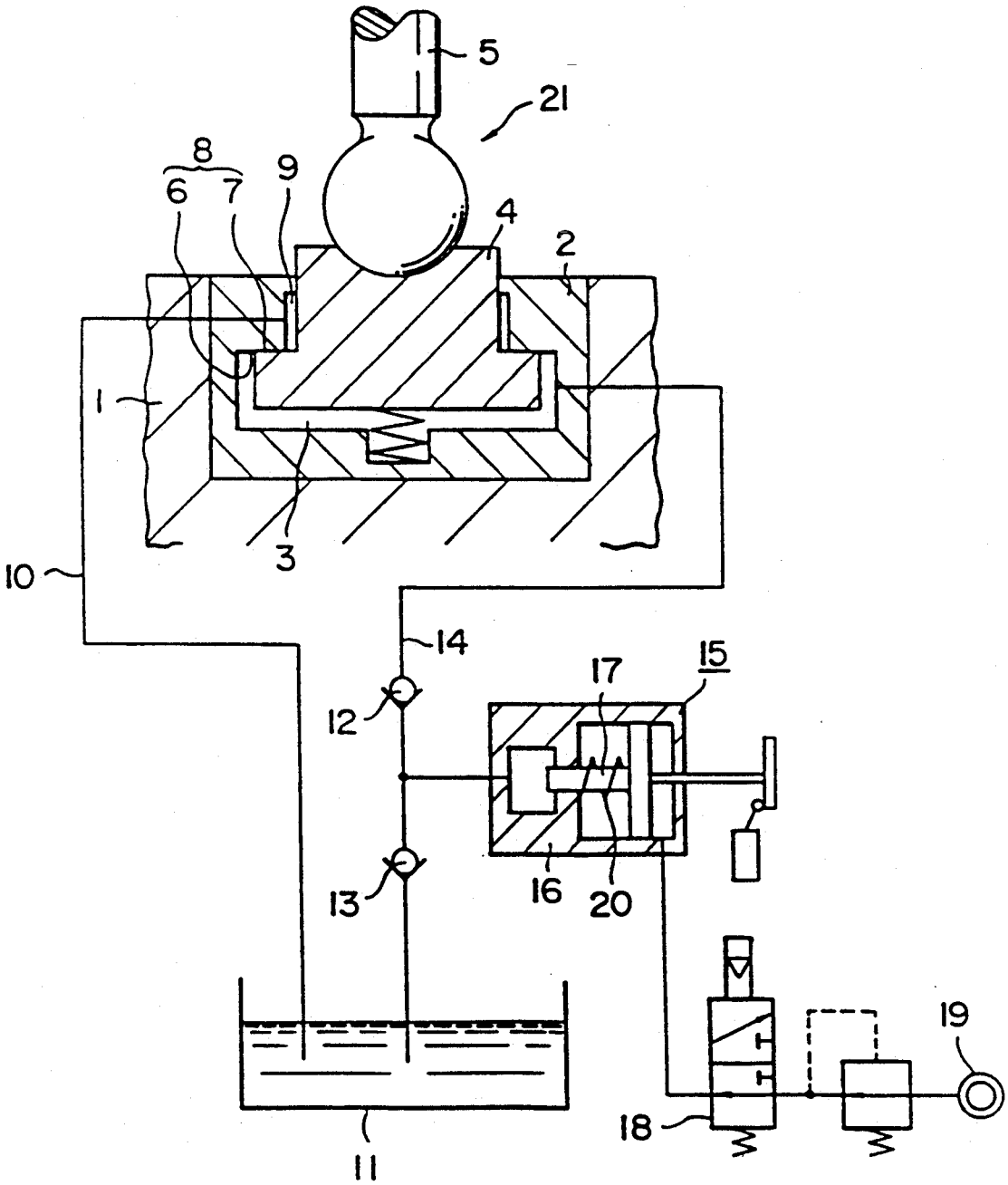
FIG. 3 PRIOR ART
FIG. 3 is a hydraulic circuit diagram of a prior-art apparatus with a hydraulic overload-protection means which was provided by the present applicant.
Figure 4:
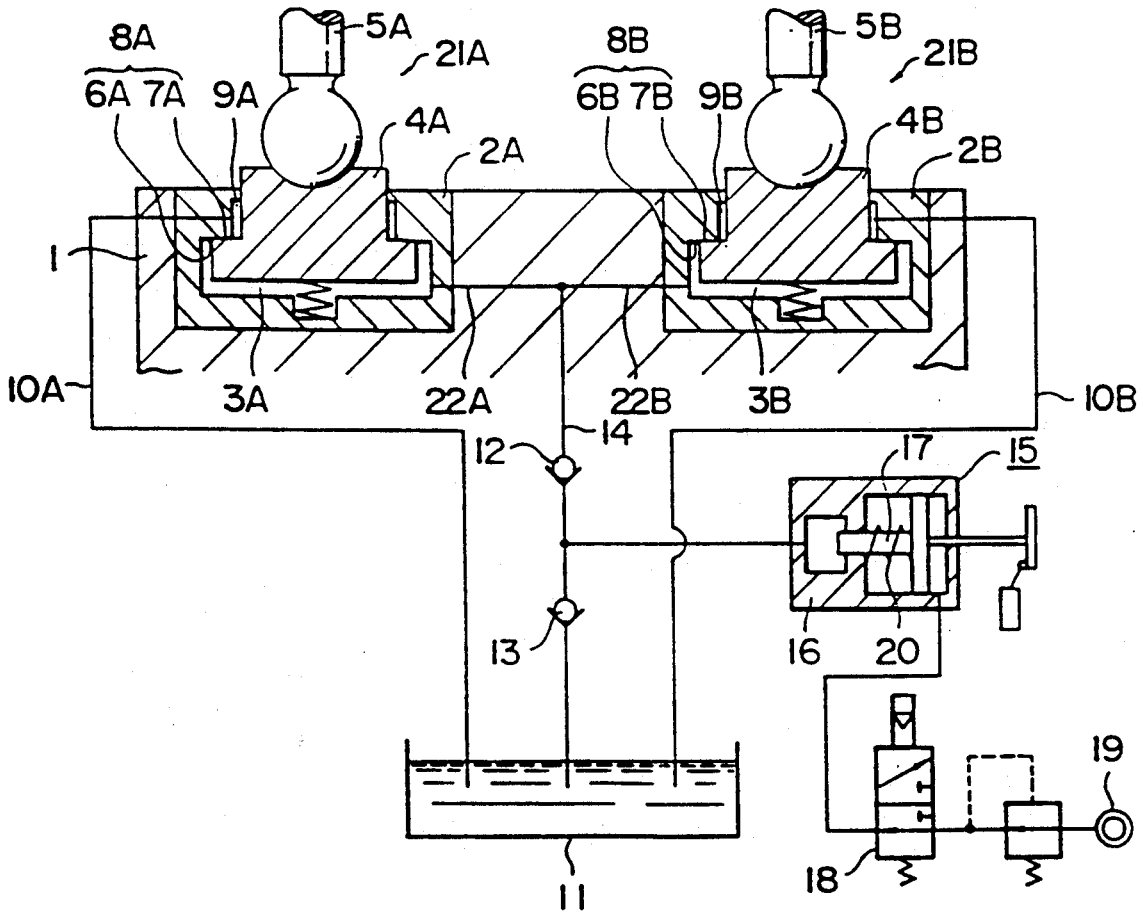
FIG. 4 PRIOR ART
FIG. 4 is a hydraulic circuit diagram of a prior-art overload protector for a two-point type press machine with two corresponding hydraulic overload-protection means of FIG. 3.

When an overload occurs in pressing and thus a press pressure applied to one of the hydraulic overload-protection means 21A and 21B, e.g., the hydraulic overload-protection means 21A becomes very high so that the pressure-receipt element 4A of the hydraulic overload-protection means 21A is descended against the hydraulic pressure contained in the hydraulic pressure chamber 3A, oil escaping through the opened seal 8A out of the hydraulic pressure chamber 3A returns through the oil return line 10A to the oil reservoir, as described in connection with FIG. 3. Thus, when the operation of the hydraulic overload-protection means 21A reduces the hydraulic pressure contained in the hydraulic pressure chamber 3A, the valve body 28A having the small pressure-receipt surface 33A receiving this reduced hydraulic pressure maintains a closed position since the large pressure-receipt surface 34A of the valve body 28A receives the hydraulic pressure contained in the hydraulic pressure chamber 3B. On the other hand, once a differential pressure between the hydraulic pressures contained in the hydraulic pressure chambers 3A and 3B exceeds a normal force produced on a difference in pressure-receipt area between the small pressure-receipt surface 33B and large pressure-receipt surface 34B of the valve body 28B, the hydraulic pressure contained in the hydraulic pressure chamber 3B acts on the small pressure-receipt surface 33B of the valve body 28B to move the valve body 28B from the closed position to the opened position.

Thus, a portion of pressurized oil escapes out of the hydraulic pressure chamber 3B to the oil reservoir 11 through the front chamber 29B, intermediate chamber 31B and oil relief line 32B so that the hydraulic pressure contained in the hydraulic pressure chamber 3B is reduced. The pres sure-receipt element 4B of the hydraulic overload-protection means 21B descends so as to also operate essentially concurrently with the hydraulic overload-protection means 21B in the same manner as the hydraulic overload-protection means 21A.

The above case occurs when the hydraulic overload-protection means 21A receives an overload earlier than the hydraulic overload-protection means 21B. A case in which load earlier than the hydraulic overload-protection means 21A is similar to the above case.

Thus, when one of the hydraulic overload-protection means 21A and 21B receives an overload to operate, a corresponding one of the valve bodies 28A and 28B of the relief valves 27A and 27B moves to the opened position to operate the other of the hydraulic overload-protection means 21A and 21B essentially concurrently with the one &hereof, i.e., without a time lag between the operations of the hydraulic overload-protection means 21A and 21B since two parallel hydraulic lines transmitting the hydraulic pressures of the hydraulic pressure chambers 3A and 3B to the relief valves 27A and 27B essentially concurrently operate the hydraulic overload-protection means 21A and 21B. Thus, the slide 1 will not be made horizontally oblique when an overload occurs, so that the slide gib vertically guiding the slide will not be damaged.

An elimination of the check valve 12 of the pressurized oil supply line 14 of the first embodiment illustrated in FIG. 1 will not essentially change the operation and advantages of the overload protector for the press machine of the first embodiment described above.

Figure 2:
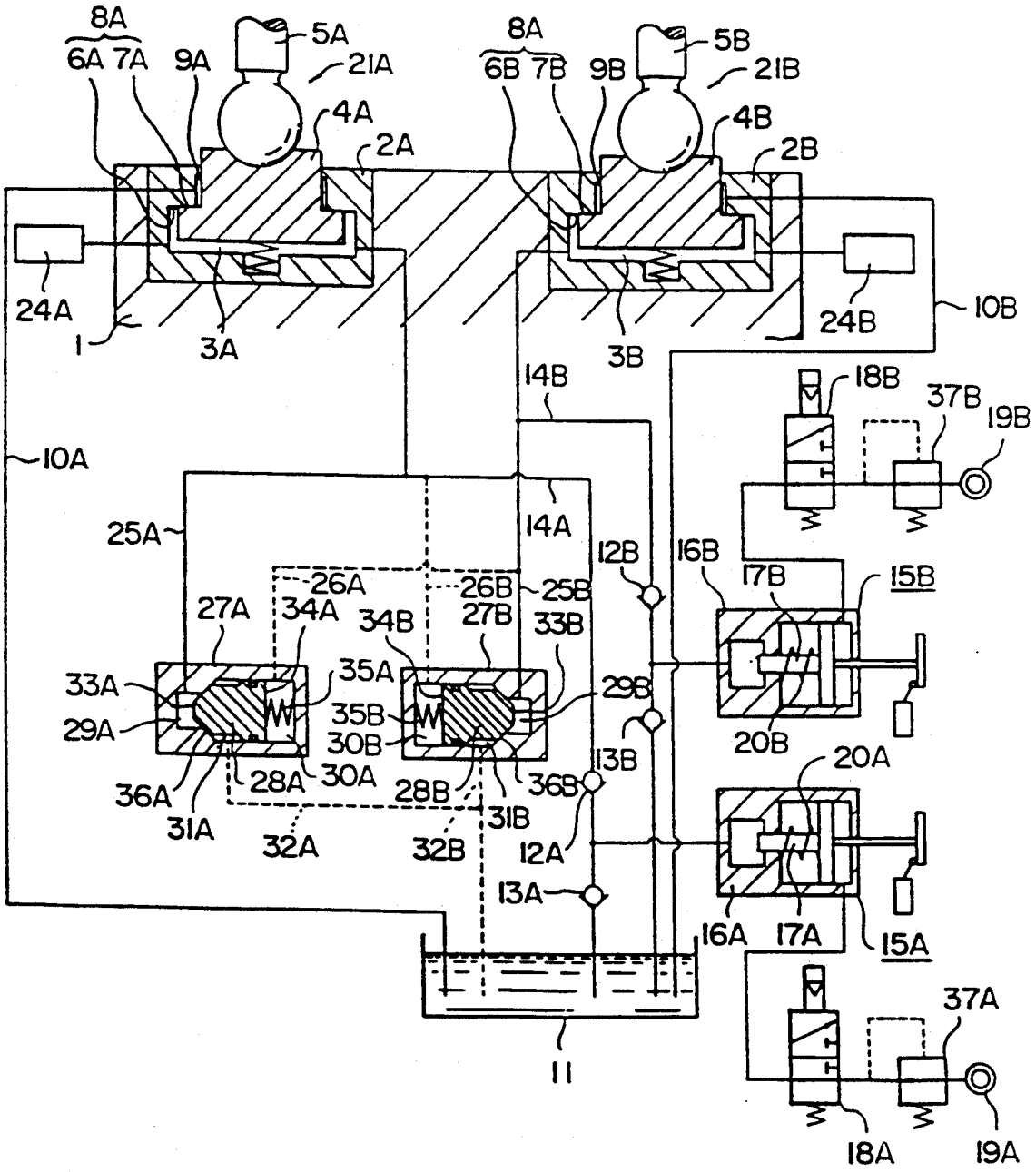
FIG. 2 is a hydraulic circuit diagram of a second embodiment of the present invention with two pressure generators and two pressurized oil supply lines.

FIG. 2 illustrates a second embodiment of the present invention providing each of two hydraulic overload-protection means 21A and 21B with one of two pressure boosters 15A and 15B and one of two pressurized oil supply lines 14A and 14B. The respective pressurized oil supply lines 14A and 14B extend to hydraulic pressure chambers 3A and 3B. As in the first embodiment illustrated in FIG. 1, the pressurized oil supply lines 14A and 14B have two relief valves 27A and 27B having valve bodies 28A and 28B, oil relief lines 32A and 32B etc. and connected therebetween in hydraulic parallel to each other through communication lines 25A, 25B, 26A and 26B.

In accordance with the second embodiment, the left-hand and right-hand hydraulic pressure chambers 3A and 3B are also hydraulically independent of each other in normal pressing as in the first embodiment. Pressure sensors 24A and 24B continuously sense the respective hydraulic pressures contained in the hydraulic pressure chambers 3A and 3B in pressing, so that the press machine continuously operates while sensing an overload acting on the underside of a slide 1. When one of the hydraulic overload-protection means 21A and 21B receives an overload to operate, a corresponding one of the valve bodies 28A and 28B of the relief valves 27A and 27B moves to an opened position to operate the other of the hydraulic overload-protection means 21A and 21B essentially concurrently with the one thereof.

In addition, since the second embodiment illustrated in FIG. 2 providing each of the hydraulic overload-protection means 21A and 21B with the one of the pressure boosters 15A and 15B and the one of the pressurized oil supply lines 14A and 14B, setting the pressures of regulators 37A and 37B of the pressure boosters 15A and 15B to be different from each other correspondingly makes different the pressures of pressurized oils to be supplied to the hydraulic pressure chambers 3A and 3B, i.e., normal hydraulic pressures contained in the hydraulic pressure chambers 3A and 3B can be set in response to a localized load acting on the underside of the slide 1.

When a difference in pressure-receipt area between small pressure-receipt surfaces 33A and 33B and corresponding large pressure-receipt surfaces 34A and 34B of the valve bodies 28A and 28B is sufficiently large, the overload protector for the press machine of the second embodiment can sufficiently handle an increasing difference between localized loads acting on the hydraulic overload-protection means 21A and 21B in pressing. Consequently, the difference in pressure-receipt area may be predetermined in response to an expected difference between localized loads acting on the underside of the slide.

In accordance with the present invention, the hydraulic pressure chambers of the left-hand and right-hand hydraulic overload-protection means are hydraulically independent of each other in normal pressing so that sensing hydraulic pressures contained in the respective hydraulic pressure chambers can sense localized loads acting on the underside of the slide in pressing, and on the other hand when one of the two hydraulic overload-protection means receives an overload, both the hydraulic overload-protection means concurrently operate. Thus, a horizontal obliqueness in the slide is eliminated, which protects the slide gib from damage.

In addition, the overload protector for the press machine of the present invention can make different set hydraulic pressures contained in the hydraulic pressure chambers of the two hydraulic overload-protection means in response to localized loads.

What is claimed is:

1. An overload protector for a press machine, comprising: two hydraulic overload-protection means for receiving respectively left and right hand press loads from the press machine, each overload protection means including:

a slide connected by a connecting rod to a crank shaft of the press machine, the slide having a hydraulic pressure chamber receiving pressurized oil therein;

a pressure receipt element vertically movably mounted within said hydraulic pressure chamber and receiving a said press load transmitted from the connecting rod;

an openable seal formed between a downward facing wall surface in said hydraulic pressure chamber and an upward facing surface of said pressure receipt element; and an oil return line for returning oil which escapes through said seal in an opened position from said hydraulic pressure chamber to an oil reservoir;

wherein the overload protector further includes a pressurized oil supply means having a pressure generator and a pressurized oil supply line delivering pressurized oil to said hydraulic pressure chamber, said pressurized oil supply line having two relief valves both connected thereto and to each other in a hydraulic parallel circuit, said circuit transmitting hydraulic pressures from the hydraulic pressure chambers to the relief valves to enable the relief valves to adjust hydraulic pressures within the chambers by selective movement of only one of the separate relief valves as a result of sensing differential hydraulic pressures between said chambers.

2. An overload protector for a press machine as recited in claim 1, wherein each of the pressure generator and the pressurized oil supply line of the pressurized oil supply means is single, the pressurized oil supply line has branched hydraulic lines each extending to one of the hydraulic pressure chambers, the branched hydraulic lines have the relief valves connected therebetween in hydraulic parallel to each other and each have a check valve blocking an oil flow from corresponding one of the hydraulic pressure chambers to the pressurized oil supply line.

3. An overload protector for a press machine as recited in claim 1, the pressurized oil supply means comprises two corresponding pressure generators and two corresponding pressurized oil supply lines, each of the hydraulic overload-protection means has one of the pressure generators and one of the pressurized oil supply lines, and the pressurized oil supply lines have the relief valves connected therebetween in hydraulic parallel to each other.

4. An overload protector for a press machine as recited in claim 1, wherein each of the hydraulic pressure chambers has a pressure sensor communicating therewith.

5. An overload protector for a press machine, comprising: two hydraulic overload-protection means for receiving respectively left and right hand loads from the press machine, each overload protection means including:

a slide connected by a connecting rod to a crank shaft of the press machine, the slide having a hydraulic pressure chamber receiving pressurized oil therein;

a pressure receipt element vertically movably mounted within said hydraulic pressure chamber and receiving a press load transmitted from the connecting rod;

an openable seal formed between a downward facing wall surface in said hydraulic pressure chamber and an upward facing surface of said pressure receipt element; and an oil return line for returning oil which escapes through said seal in an opened position from said hydraulic pressure chamber to an oil reservoir;

wherein the overload protector further includes a pressurized oil supply means having a pressure generator and a pressurized oil supply line delivering pressurized oil to said hydraulic pressure chamber, said pressurized oil supply line having two relief valves both connected thereto and to each other in a hydraulic parallel circuit, said circuit transmitting hydraulic pressures from the hydraulic pressure chambers to the relief valves to enable the relief valves to adjust hydraulic pressures within the chambers by selective opening movement as a result of sensing differential hydraulic pressures between said chambers, wherein each of the relief valves includes: a valve body movable between opened and closed positions and having two pressure-receipt surfaces with different pressure-receipt areas, the pressure-receipt surfaces receiving hydraulic pressure from the hydraulic pressure chambers oppositely acting to each other; and an oil relief line releasing in response to the opened position of the valve body oil from corresponding ones of the hydraulic pressure chambers the hydraulic pressure in which acts on a small pressure-receipt surface of the valve body.

6. An overload protector for a press machine as recited in claim 5, wherein a ratio between a hydraulic pressure contained in the corresponding one of the hydraulic pressure chambers to operate corresponding one of the hydraulic overload-protection means and a second hydraulic pressure contained in the corresponding one of the hydraulic pressure chambers not to operate the corresponding hydraulic overload-protection means determine a ratio between the pressure-receipt areas of the two pressure-receipt surfaces of the valve body of the relief valve.

7. An overload protector for a press machine as recited in claim 5, wherein a valve case of the relief valve defines therewithin a front chamber, rear chamber and intermediate chamber together with the valve body, the small pressure-receipt surface of the valve body faces the front chamber, the large pressure-receipt surface of the valve body faces the rear chamber, and the intermediate chamber communicates with the oil relief line.

8. An overload protector for a press machine comprising at least a pair of hydraulic overload protection means for receiving respectively left and right hand loads from the press machine, each overload protection means including a slide connected by a connecting rod to a crank shaft of the press machine, the slide having a hydraulic pressure chamber receiving pressurized oil therein; a pressure receipt element vertically movably mounted within the hydraulic pressure chamber and receiving a press load transmitted from the connecting rod; an openable seal formed between the hydraulic pressure chamber and an oil return line which returns oil escaping through the seal in the open position from the hydraulic pressure chamber to an oil reservoir; wherein the overload protector further includes a pressurized oil supply means having a pressure generator means and pressurized oil supply line means for delivering pressurized oil to said hydraulic pressure chambers; said pressurized oil supply line means having at least two relief valve means respectively connected to the pressurized oil supply line means and the chambers and each other in a hydraulic parallel circuit, wherein said at least two relief valve means are independently adjustable to thereby enable opening of each seal under different localized and predetermined loads acting on the respective ones of the hydraulic overload protector means during pressing, wherein each of the relief valves includes: a valve body movable between opened and closed positions and having two pressure-receipt surfaces with different pressure-receipt areas, the pressure-receipt surfaces receiving hydraulic pressure from the hydraulic pressure chambers oppositely acting to each other; and an oil relief line releasing in response to the opened position of the valve body oil from corresponding ones of the hydraulic pressure chambers the hydraulic pressure in which acts on a small pressure-receipt surface of the valve body.

* * * * *